US006004110A

United States Patent [19]

Merz et al.

[11] Patent Number: 6,004,110

[45] Date of Patent: Dec. 21, 1999

[54] DISPLACEMENT PUMP

[75] Inventors: Johann Merz; Ralf Steindl, both of Schwäbisch Gmünd; Uwe Zellner, Iggingen, all of Germany

[73] Assignee: Zf Friedrichshafen AG, Friedrichshafen, Germany

[21] Appl. No.: 09/064,010

[22] Filed: Apr. 22, 1998

[30] Foreign Application Priority Data

Apr. 26, 1997 [DE] Germany ..... 197 17 794

[51] Int. Cl.[6] ..... F04B 49/00

[52] U.S. Cl. ..... 417/310; 417/440

[58] Field of Search ..... 417/310, 440

[56] References Cited

U.S. PATENT DOCUMENTS

| | | | |
|---|---|---|---|
| 5,209,648 | 5/1993 | Ishizaki et al. | 417/310 |
| 5,803,716 | 9/1998 | Wallis et al. | 417/440 |
| 5,807,081 | 9/1998 | Schutte et al. | 417/310 |

FOREIGN PATENT DOCUMENTS

| | | |
|---|---|---|
| 1675469 | 3/1970 | Germany . |
| 2402017 | 3/1983 | Germany . |
| 195 21 635 | 12/1996 | Germany . |

*Primary Examiner*—John Kwon
*Attorney, Agent, or Firm*—Larson & Taylor

[57] ABSTRACT

In a displacement pump for pumping pressure medium out of a container to a consumer, in particular a servo-assisted steering system for motor vehicles, a pump package (2) is inserted into the interior of a housing (1). The pump package (2) comprises a rotor (3), a cam ring (4) and a plurality of operating rods (5). Between the cam ring (4) and the rotor (3), work chambers divided by the operating rods (5) are formed, which are bounded in the axial direction by control plates (8, 9). A bypass flow limiting to valve (11) is used to regulate an effective flow. A throttle (12) of the bypass flow limiting valve (11) is formed by at least one bore. The throttle (12) is embodied in a throttle insert (13), which to adjust a characteristic effective flow curve can be mounted in various positions between a pressure chamber of the pump and the bypass flow limiting valve (11). To that end, the throttle insert (13) is integrated with a control plate (9). In addition, at least two bores (14, 15) are provided in the throttle insert (13), which discharge into a pressure kidney (10*a*) disposed in the control plate (9). A control plate is a precision part, so that the flow conditions and thus the characteristic governing curves can be reproduced very accurately. As a result of the mutual influence of the two throttle bores, the governing tolerance is not sensitive to minor errors in the rotary position of the throttle insert.

4 Claims, 1 Drawing Sheet

Fig. 1
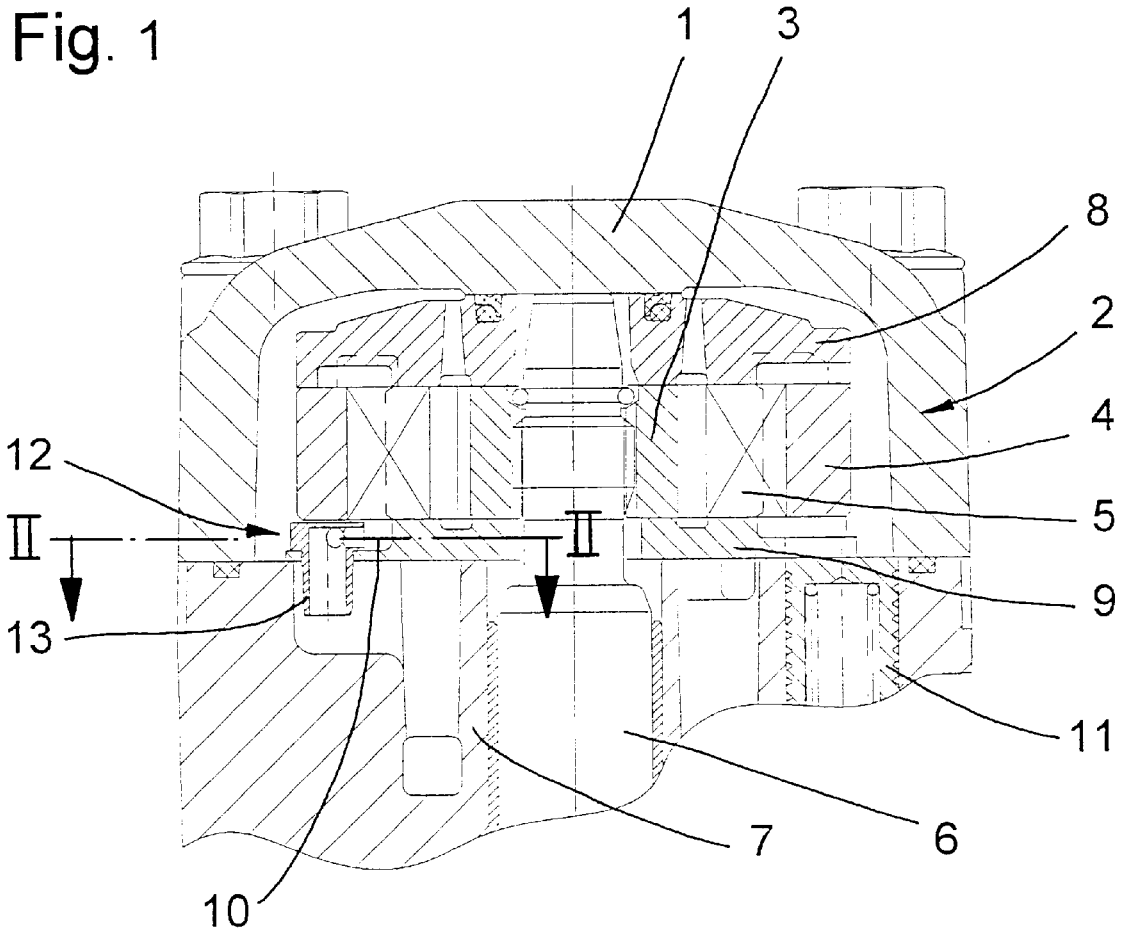
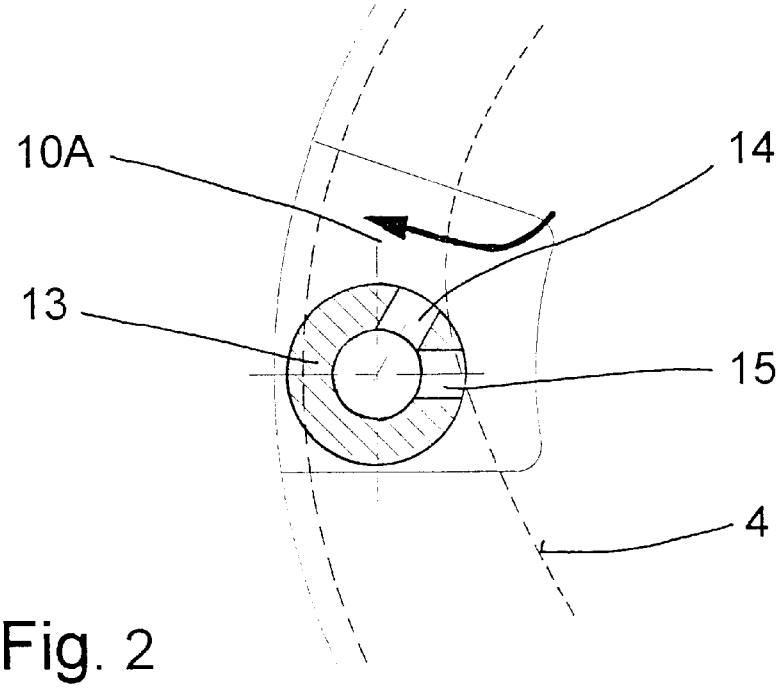
Fig. 2

DISPLACEMENT PUMP

BACKGROUND OF THE INVENTION

1. Field of the Invention

The invention relates to a displacement pump for pumping pressure medium from a container to a consumer, in particular a servo-assisted steering system for motor vehicles. Inserted into the interior of the housing is a pump package, comprising a rotor, a cam ring, and a plurality of operating rods. By way of example, the operating rods may be embodied as vanes of a vane cell pump or as rollers of a roller cell pump. Between the cam ring and the rotor, work chambers are formed, which are subdivided by the operating rods and are bounded in the axial direction by control plates. A bypass flow limiting valve is used to regulate an effective flow. A throttle of the bypass flow limiting valve is formed by at least one bore. The throttle is embodied as a throttle insert, which to adjust a characteristic effective flow curve can be mounted in various positions between a pressure chamber of the pump and the bypass flow limiting valve.

2. Brief Description of the Prior Art

One such displacement pump is known from German Patent DE 24 02 017 C2 or U.S. Pat. No. 3,989,414. In this pump, a throttle insert is inserted into a pressure conduit transverse to the flow course. As a result, in the pressure conduit, a point of restricted cross section is formed. At this point the throttle bore discharges into the pressure conduit.

It has been found that this arrangement, under certain circumstances, reacts very sensitively to the rotary position of the throttle insert. Since the pressure conduit is a cast conduit that has a surface that is not entirely uniformly reproducable, the regulating characteristic curve of the flow regulating valve cannot be predetermined with the requisite precision.

The object of the invention is to achieve a more precise-tolerance characteristic curve of the flow regulating valve of a displacement pump.

SUMMARY OF THE INVENTION

This object is attained by the displacement pump defined by the present invention. To that end, in a generic displacement pump, the throttle insert is integrated with a control plate. In addition, at least two bores are provided in the throttle insert, which discharge into a pressure kidney disposed in the control plate. A control plate is a precision part, so that the flow conditions and thus the characteristic governing curves can be reduced very accurately. As a result of the mutual influence of the two throttle bores, the governing tolerance is less sensitive to minor errors in the rotary position of the throttle insert. The characteristic governing curves can be determined very accurately by means of a very precise adjustability of the rotary position with regard to the main flow direction.

Advantageous and expedient features of the invention are described in the specification. It is especially expedient if one of the bores is located in a region of high flow velocity. As a result, the drop in static pressure is highly pronounced. It is also advantageous if one of the bores is located parallel to a main flow direction of the pumped pressure medium, and that the other bore is located at an angle to this main flow direction.

The invention will be described in further detail below in terms of an exemplary embodiment shown in the drawing.

BRIEF DESCRIPTION OF THE DRAWINGS

As shown:

FIG. 1, a partial longitudinal section through the displacement pump of the invention; and FIG. 2, a partial cross section taken along the line II—II of FIG. 1, on a larger scale.

DETAILED DESCRIPTION OF THE PREFERRED EMBODIMENT

The invention will be described in terms of an example of a vane cell pump. However, the invention can also be employed with the same effect in other displacement pumps, for instance in roller pumps.

A pump package 2, which comprises a rotor 3, a cam ring 4, and a plurality of operating rods S, is inserted into a housing 1. The rotor 3 is supported via a drive shaft 6 in a bearing housing 7.

Between the operating rods 5 and the cam ring 4, work chambers, not shown, in the form of displacement cells are formed, which are bounded on their two axial ends by two control plates 8 and 9. Pressure openings 10 and suction openings, not shown, are provided in a known manner in the control plates 8 and 9. At least one of the pressure openings 10 takes the form of a pressure kidney 10*a*. One such pressure kidney 10*a* can be seen in FIG. 2.

A bypass flow limiting valve 11 is disposed in a known manner in the housing 1. A throttle 12 of the bypass flow limiting valve 11 is embodied in a throttle insert 13. The throttle insert 13 is inserted into the control plate 9. It has two bores 14 and 15, which discharge into the pressure kidney 10*a* of the pressure opening 10. The axes of the two bores 14 and 15 form an angle. At least one of the bores 14, 15 is located in a region of high flow velocity. Besides the exemplary embodiment with two bores, versions with more than two bores are also possible.

The flow conduit is bounded on two sides by the control plates 8, 9. One side each is defined by the cam ring 4 and one wall of the pressure kidney 10*a*. The cam ring 4 is suggested by dashed lines in FIG. 2. In FIG. 2, the flow conduit is located essentially above the throttle insert 13. The region below the throttle insert 13 is blocked off nearly entirely, or entirely.

The one bore 15 is oriented parallel to the main flow direction of the pumped pressure medium, while the other bore 14 is at an angle to the main flow direction of the pumped pressure medium. The main flow direction is indicated by an arrow in FIG. 2.

In typical double-flow pumps, a further advantage of this arrangement is that only the pressure medium from a pressure zone affects the characteristic governing curves, while the pressure medium from the other pressure zone has no influence on the characteristic curve.

We claim:

1. A displacement pump for pumping pressure medium out of a container to a consumer, useful in a servo-assisted steering system for motor vehicles, including:

a pump package, comprising a rotor, a cam ring, and a plurality of operating rods, inserted into the interior of a housing;

between the cam ring and the rotor, work chambers divided by the operating rods are formed, which work chambers are bounded in an axial direction by control plates;

a bypass flow limiting valve is used to regulate an effective flow;

a throttle of the bypass flow limiting valve is formed by at least one bore; and the throttle is embodied in a throttle insert, which to adjust a characteristic effective flow curve is adjustably mounted between a pressure chamber of the pump and the bypass flow limiting valve, the improvement comprising:

the throttle insert is formed integrally with a control plate; and at least two bores are provided in the throttle insert, which bores discharge into a pressure kidney disposed in the control plate.

2. The displacement pump of claim 1, wherein at least one of the bores is located in a region of high flow velocity.

3. The displacement pump of claim 2, wherein one of the bores is located parallel to a main flow direction of pressure medium pumped by the pump package, and that the other bore is located at an angle to the main flow direction of the pumped pressure medium.

4. The displacement pump of claim 1, wherein a rotary position of the throttle insert is adjustable to adjust the characteristic effective flow curve.

* * * * *